US005495801A

United States Patent [19]

Dankert

[11] Patent Number: 5,495,801

[45] Date of Patent: Mar. 5, 1996

[54] PRESSURE-SENSITIVE TACKY PRINTING ROLLER FOR REMOVING PRINTING INKS FROM A PRINTING PLATE

[76] Inventor: Fred Dankert, R.R. 3, Box 99, Oxford, N.Y. 13830

[21] Appl. No.: 265,166

[22] Filed: Jun. 24, 1994

[51] Int. Cl.[6] ..... B41F 31/26

[52] U.S. Cl. ..... 101/348; 101/349; 101/450.1; 492/56

[58] Field of Search ..... 101/148, 348, 101/349, 425, 450.1, 217, 375, 376, 492; 492/56, 59; 428/909

[56] References Cited

U.S. PATENT DOCUMENTS

| | | | |
|---|---|---|---|
| 2,088,471 | 7/1937 | Freedlander | 492/56 |
| 2,278,982 | 4/1942 | Frolich | 492/56 |
| 3,293,728 | 12/1966 | Hill | 492/59 |
| 3,387,074 | 6/1968 | Hill | 101/415.1 |
| 3,724,047 | 4/1973 | Peterson | 101/348 |
| 3,800,366 | 4/1974 | Hill | 101/348 |
| 4,038,731 | 8/1977 | Hill | 492/56 |
| 4,296,172 | 10/1981 | Hill | 101/375 |
| 4,403,550 | 9/1983 | Sharp | 101/451 |
| 4,751,127 | 6/1988 | Pinkston et al. | 101/401 |
| 4,829,645 | 5/1989 | Kannwischer | 101/348 |
| 5,207,158 | 5/1993 | Fadner et al. | 101/450.1 |

FOREIGN PATENT DOCUMENTS

| | | | |
|---|---|---|---|
| 231763 | 11/1985 | Japan | 101/348 |

*Primary Examiner*—Stephen Funk
*Attorney, Agent, or Firm*—Salzman & Levy

[57] ABSTRACT

A printing roller, or form roller, having sufficient pressure-sensitive tack for cleanly removing ink from non-image areas of a waterless planographic plate irrespective of the tackiness of the ink. The roller can be fabricated with the necessary pressure-sensitive tack by disposing a coated sleeve, or coating layer, upon the peripheral surface of a standard roller base. The surface of the coating is elastomeric. Elastomers that will work with this invention can be selected from a group consisting of: butyl rubber, nitrile rubber, styrene butadiene, polychoroprene, polysulfide, polyurethane, polyolefin, polyvinyl acetate, acrylics, gelatine/aldehyde, epoxies, and combinations thereof.

6 Claims, 2 Drawing Sheets

PRESSURE-SENSITIVE TACKY PRINTING ROLLER FOR REMOVING PRINTING INKS FROM A PRINTING PLATE

FIELD OF THE INVENTION

The present invention relates to waterless planography, and more particularly to an improved press roller article for waterless planography printing, that removes ink from the printing plate in non-image areas, without the necessity for water cooling the press, and irrespective of the tackiness characteristic of the printing ink.

BACKGROUND OF THE INVENTION

The success of waterless planography is dependent upon there being a low free surface energy polymer overlaying the non-print areas of the printing plate. The polymer prevents ink from wetting the non-printing areas, thus clearly delineating the image areas which accept the ink.

The process will only work when the ink has sufficient viscosity defined by the properties of "tack" (viscoelasticity), and "body" (non-Newtonian plastic viscosity). Inks having these properties, are repelled by the low free surface energy polymer that overlays the non-print areas of the plate.

In actual practice, however, inks having the sufficient "tack" and "body" properties, are often too viscous, and will rupture paper media used on most printing presses.

Another problem with the printing inks results from the high speed of the printing operation. The high speed rollers generate a considerable amount of heat, which will quickly reduce ink viscosities to the point where they will not work. Therefore, many systems have installed water-cooled rollers to maintain proper ink viscosity. Water-cooled rollers, however, are expensive to install and difficult to operate.

The present invention has developed an article and method for resolving the aforementioned problems.

The invention observes that the "form roller" is responsible for causing the plate to be swept clean of ink tone in the non-printing areas. Normal rollers without ink generally separate from the plate surface with very little pull being exerted between the roller and plate. Hence, it is realized that only the ink provides the pulling force at separation.

The invention has discovered that should the roller be fabricated in such a manner as to be sufficiently tacky, then this will allow the printing to be accomplished free of tone, while using low viscosity inks. In other words, the rollers now replace the function of "tackiness" and/or tone removal originally the province of high viscosity inks. This observation and discovery flies in the face of conventional practice and wisdom, since tacky rollers are believed to hinder the printing process.

The use of low viscosity inks with the "tacky" roller of this invention, will in turn allow for the printing operation to be accomplished without the need for water-cooled rollers. This is so, because even though the inks may become less viscous as the rollers generate heat and raise the temperature of the inks, the rollers will remain tacky despite the increased temperature.

The use of the low viscosity inks will also allow the printing operation to use the commercially available paper media without concern that they will rupture during printing.

The "tackiness" provided by the roller article of this invention, has a slightly different property than that observed for inks. Ink "tackiness" can be defined as the resistance to the force of separation of liquids from solid surfaces, a quality similar to liquid surface tension. The "tackiness" of the roller apparatus of this invention, however, is defined as: "pressure-sensitive tack". "Pressure-sensitive tack" can be further defined as the quality or property of the separation of solid surfaces that are in contact with each other, and which separate cleanly.

The invention, having utilized a new property in the fabrication and use of ink rollers, has developed a test by which the "pressure-sensitive tack" of the roller can be quantitatively measured. This is necessary, in order to provide precision and accuracy to the fabrication process, and in the assessment of roller workability.

To measure tack as defined above, the invention has constructed a device as follows: A smooth coated paper (from a single mill run) is cut to a length two inches wide and six inches long. The paper is placed on a clean glass surface with weights placed on the distal ends of the paper at distances one-half inch from the edge at the middle of the paper width. The fabricated roller, whose tackiness is to be measured is placed in contact with the paper at its mid-point. Next, the roller is lifted from the paper. It will be observed that if the roller has sufficient "pressure-sensitive tack", then it will lift the paper, causing it to buckle. The total amount of weight that will hold the paper from being lifted, therefore, is the force that quantitatively defines the quality of "Pressure-sensitive tack".

The invention has found that weights in the range of between 200 and 1,000 grams indicate a "pressure-sensitive tack" sufficient to provide a roller that will remove the ink from the non-image areas of the plate surface.

SUMMARY OF THE INVENTION

In accordance with the present invention, there is provided a printing roller, or "form roller", having sufficient "pressure-sensitive tack" for cleanly removing ink from non-image areas of a waterless planographic plate, irrespective of the tackiness of the ink. The roller can be fabricated with the necessary "pressure-sensitive tack" by disposing a coated sleeve, or coating layer, upon the peripheral surface of a standard roller base. The surface of the layer is elastomeric. Elastomers that will work with this invention can be selected from a group consisting of: butyl rubber, nitrile rubber, styrene butadiene, polychoroprene, polysulfide, polyurethane, polyolefin, polyvinyl acetate, acrylics, gelatine/aldehyde, epoxies, and combinations thereof. A preferred elastomer coating can be formed by admixing a liquid butadiene acrylonitrile copolymer with liquid epoxide terminated polysulfides. An epoxy curative agent is added just prior to applying the coating to the roller base or sleeve. The cured coatings may advantageously contain small amounts of unreacted, soluble elastomer species, that provide additional tackiness. The wear properties of the coating are improved with the addition of filler materials such as, titanium dioxide. Titanium dioxide provides the further property of high free surface energy. This allows the roller surface to be easily wetted by inks, and may also favorably influence the separation of the ink from the non-image areas of low free surface energy printing plates.

It is an object of this invention to provide an improved printing article and method for performing waterless planography.

It is another object of the invention to provide a roller that will have sufficient "pressure-sensitive tack" to remove ink from non-image areas of a planographic plate.

It is a further object of this invention to perform waterless planography without the need for water-cooled rollers and/or high viscosity inks.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a new "tacky" roller for removing ink from non-image areas of a planographic printing plate. The "tacky" roller comprises a standard roller base that has been coated with an elastomer sufficient to provide "pressure-sensitive tack", as defined herein.

Figure 1B:
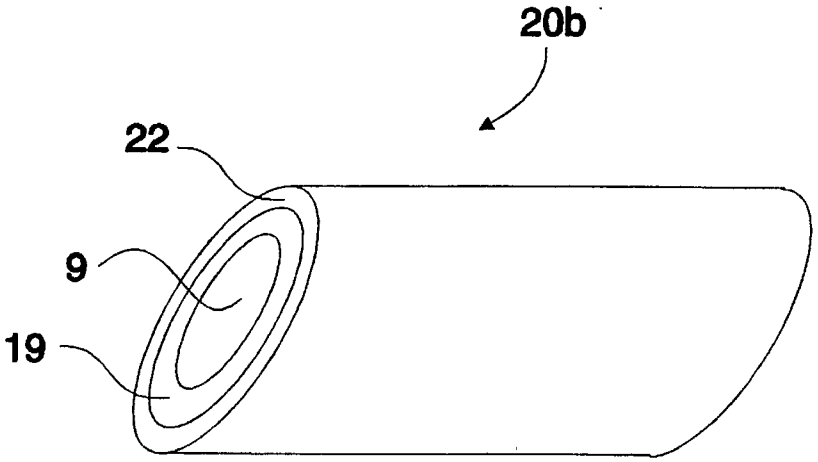
FIG. 1*b* shows a perspective view of another embodiment of the roller article of this invention.
Figure 1A:
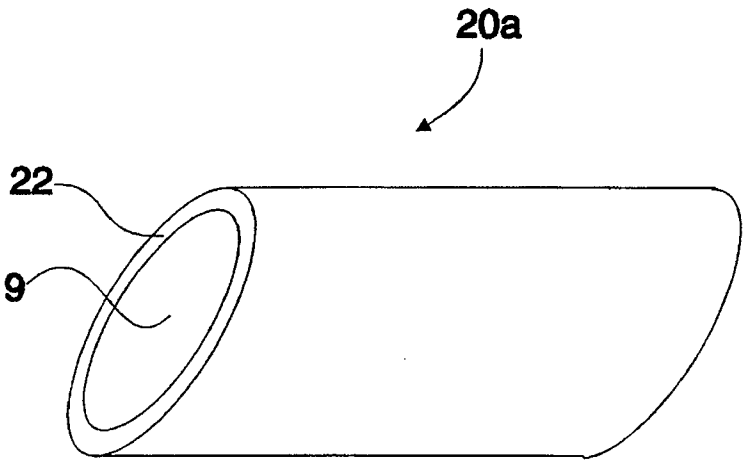
FIG. 1*a* depicts a perspective view of one embodiment of the roller article of this invention.

Now referring to FIGS. 1*a* and 1*b*, respectively, the respective roller articles 20*a* and 20*b*, of this invention, are shown. The rollers of the present invention were fabricated with the necessary "pressure-sensitive tack" by coating an elastomeric layer 22 (FIG. 1*a*) on a standard roller base 9, from 1 to 2 mills thick. The elastomer surface can also be fabricated by coating layer 22 (FIG. 1*b*) upon a sleeve 19 that is disposed over the roller base 9. The elastomeric substance is cured and allowed to harden for one or two days.

A typical waterless plate was placed on a multilith press and printed with a waterless ink reduced with ink solvent (Magsol 52) until toning occurred. One of the form rollers was removed from the press, and replaced with a roller fabricated in accordance with the invention, i.e. a roller coated with an elastomeric substance having sufficient "pressure-sensitive tack", as will be described in greater detail, hereinafter.

It was observed that the roller of this invention cleaned the waterless plate, and this clean condition continued through multiple printing revolutions.

A similar test was conducted utilizing a Consolidated 140 proof press whose temperature was raised via running, to produce toning. When the conventional form roller was replaced with the invention, the plate immediately cleaned free of tone. Subsequently, the rollers of the press were washed free of ink, and then inked again. The clean coating of the invention remained tacky, and performed as before.

The roller article of this invention was fabricated in accordance with the following examples:

EXAMPLE 1

A elastomeric coating substance was prepared by dissolving 26 parts of a liquid butadiene acrylonitrile copolymer, 10 parts of an epoxy terminated polysulfide oligomer, 4 parts of tris (dimethylaminomethyl) phenol, in 60 parts of toluene. This coating was applied to a standard printing roller to a thickness of approximately one to two mils thick. The coating was allowed to cure for approximately two days. Once cured, a "tacky" surface resulted which had sufficient "pressure-sensitive tack", as measured by the test described hereinafter, with reference to FIG. 2. The roller exhibited sufficient stiffness, such that it performed with the characteristic elastomeric properties without scuffing or being cut.

A printing run was performed with a standard waterless plate, a standard press (standard roller) and convential ink. The plate printed clean. The ink was reduced in viscosity to the point that it performed like soft offset ink (as used on web presses for printing newsprint). The ink toned badly with the ordinary rollers. The use of the roller fabricated in accordance with EXAMPLE 1, provided clean printing. The waterless plate was heated to 110° F., as measured by a surface thermometer. The tacky elastomeric surface of the inventive roller still printed clean. Thereafter, the inventive roller was washed clean of ink, using press solvent. Subsequent inkings and printings resulted in clean printing. The "pressure-sensitive tack" of the coating was measured by the test method described hereinafter, with respect to FIG. 2. The roller was able to lift the paper at approximately 200 to 300 grams of weight.

EXAMPLE 2

A coating was prepared by 3 roller milling 50% by weight titanium dioxide in a combination of 40% by weight low molecular weight epoxy and 60% by weight high molecular weight epoxy- terminated polysulfide oligomers. This base was combined with liquid butadiene acrylonitrile copolymer so that there were equal amounts of polysulfide oligomer, acrylonitrile copolymer and titanium dioxide. A solution of 6% by weight tris (dimethylamino methyl) phenol was added to the mixture. This coating was applied and cured to a standard roller, and the same test performed as in EXAMPLE 1. The roller performed as before. The tack weight for the "pressure-sensitive tack" test was approximately 200 to 400 grams.

EXAMPLE 3

A coating was prepared in the same manner as described in EXAMPLE 2 with the exception that 5% by weight of a high molecular weight polysulfide oligomer without epoxide groups was used in the admixture. A tackier roller was produced. All other properties were the same as before. The roller performed with similar results. The tack test measured between 300 and 500 grams.

EXAMPLE 4

A coating was prepared by 3 roller milling a base made with 53.9 parts of a poly (oxyalkylene) polyol with an hydroxyl content of 0.85, with 9.0 parts of a poly (oxyalkylene) polyol with a hydroxyl content of 11.2, and 20.0 parts of titanium dioxide. To this was added 4.0 parts of a molecular sieve zeolite dispersed in 50% by weight caster oil. The admixture was thoroughly mixed, and 13 parts of a poly isocyanate prepolymer having a diphenylmethane 4,4 di-isocyanate base was added. To this admixture was added 0.1 parts of a 1% by weight solution of Dibutyl tin dilaurate in propylene glycol mono methyl ether acetate. The coating was applied to the roller in EXAMPLE 1. This polyurethane-coated roller had similar properties to those in EXAMPLE 1. The tack test yielded weights of approximately between 250 and 400 grams.

EXAMPLE 5

A coating was prepared by 3 roller milling a base made with 44 parts of a polyester polyol with a hydroxyl content of 5.0 and 44 parts of titanium dioxide. To this admixture was added 3 parts of a molecular sieve zeolite dispersed in 50% by weight caster oil. The admixture was thoroughly mixed, and 13 parts of a poly isocyanate prepolymer having a diphenylmethane 4,4 di-isocyanate base was added. After mixing, 0.1 parts of a 1% by weight solution of dibutyl tin di laurate in propylene glycol mono methyl ether acetate was added. This coating was then applied to the roller of EXAMPLE 1. The results were essentially the same as in EXAMPLE 4. The tack test weights were approximately between 200 and 400 grams.

Figure 2:
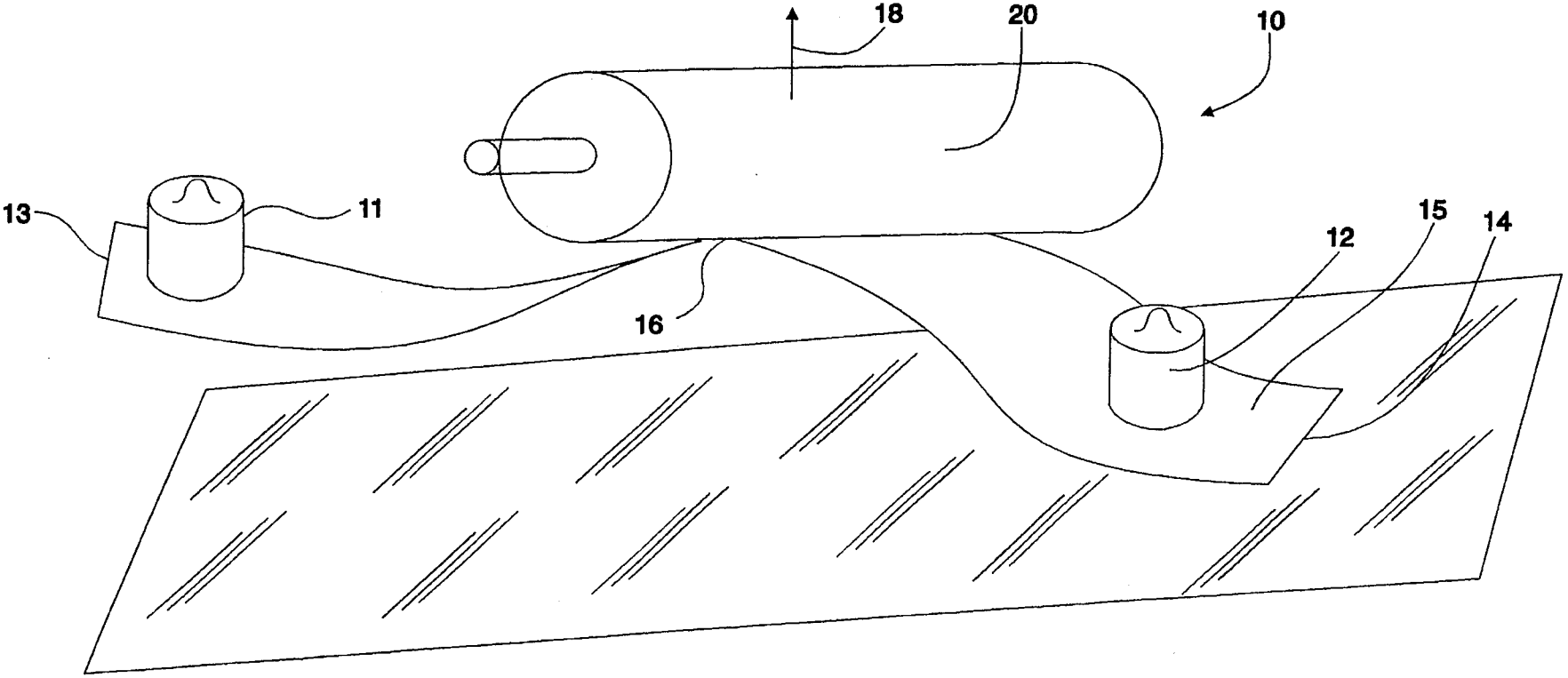
FIG. 2 illustrates a perspective view of the apparatus used by the invention to measure the property of: "pressure-sensitive tack" of a roller used in waterless planography in accordance with the principles and objectives enumerated herein, and as shown in FIGS. 1*a* and 1*b*.

Now referring to FIG. 2, the "tacky" rollers fabricated in the aforementioned EXAMPLES, were each tested for sufficient "pressure-sensitive tackiness" as defined in this specification, by use of the illustrated apparatus 10. Equal weights 11 and 12, respectively, were placed at distal ends 13 and 14, respectively of printing paper 15 (2"×6"), resting upon a flat, smooth, glass surface 17. The weights 11 and 12 were placed approximately about one-half inch from each edge of paper 15, and approximately in the middle of the width of the paper. Each roller 20 of the invention as fabricated according to the EXAMPLES, was placed in contact with the paper 15, at its mid-portion 16, as shown. After the roller 20 was allowed to adhere to paper 15, the roller 20 was raised (arrow 18) from the flat surface 17, thus drawing the paper off the surface 17, as depicted in FIG. 2.

The roller 20 was found to have sufficient tackiness, as defined herein as (pressure-sensitive tack), when the weights 11 and 12 totalled approximately between 200 and 1,000 grams, and the tackiness of the roller 20 was sufficient to lift the paper 15 off the surface 17.

It is desirable for a roller made in accordance with this invention to also have the following properties:

a. Stiffness sufficient to avoid collapse or tearing of the roller.

b. Sufficient elasticity to conform to the plate and other rollers in the press.

c. Good ink receptivity without damage to the surface.

d. Capability of being washed of ink without losing its tackiness.

e. Capability of operating at press temperatures (heated temperatures during a long run) without losing tackiness.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A printing roller having a pressure-sensitive tack for cleanly removing inks from non-image areas of a waterless planographic plate, said printing roller comprising a roller base having a pressure-sensitive tack for cleanly removing said ink from said non-image areas of said waterless planographic plate, irrespective of a wide range of tackiness characteristics of inks, a material for said roller base providing a pressure-sensitive tacky surface, and comprising in admixture a liquid butadiene acrylonitrile copolymer and a liquid epoxide terminated polysulfide in an approximate ratio by weight of at least 2:1 butadiene acrylonitrile copolymer to expoxide terminated polysulfide.

2. The printing roller in accordance with claim 1, wherein said material providing a pressure-sensitive tack forms part of a coating disposed on a peripheral surface of said roller base.

3. The printing roller in accordance with claim 1, wherein said admixture further comprising a filler material.

4. The printing roller accordance with claim 3, wherein said filler material comprises titanium dioxide.

5. The printing roller in accordance with claim 1, wherein said printing roller comprises a form roller.

6. The printing roller in accordance with claim 1, wherein said roller base has an uncoated peripheral surface, and said pressure-sensitive tack surface forms part of a sleeve disposed upon said peripheral surface of said roller base.

* * * * *